US005937545A

United States Patent [19]

Dyer et al.

[11] Patent Number: 5,937,545

[45] **Date of Patent: *Aug. 17, 1999**

[54] FOOTWEAR HEEL STABILIZER CONSTRUCTION

[75] Inventors: Robert M. Dyer, St. Louis County, Mo.; Zenon O. Smotrycz; Edward J. Norton, both of Middlesex County, Mass.

[73] Assignee: Brown Group, Inc., St. Louis County, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/824,851

[22] Filed: Mar. 26, 1997

[51] Int. Cl.[6] ..... A43B 21/26; A43B 13/18; A43B 13/14

[52] U.S. Cl. ..... 36/35 R; 36/28; 36/31

[58] Field of Search ..... 36/28, 31, 35 R, 36/30 R

[56] References Cited

U.S. PATENT DOCUMENTS

| | | | |
|---|---|---|---|
| 4,316,332 | 2/1982 | Giese et al. | 36/28 |
| 4,598,487 | 7/1986 | Misevich | 36/28 X |
| 4,815,221 | 3/1989 | Diaz . | |
| 4,878,301 | 11/1989 | Kiyosawa . | |
| 4,879,821 | 11/1989 | Graham et al. . | |
| 4,970,807 | 11/1990 | Anderie et al. | 36/28 |
| 5,070,629 | 12/1991 | Graham et al. . | |
| 5,680,714 | 10/1997 | Lopez | 36/27 |
| 5,729,917 | 3/1998 | Slepian et al. . | |

*Primary Examiner*—Ted Kavanaugh

*Attorney, Agent, or Firm*—Polster, Lieder, Woodruff & Lucchesi, L.C.

[57] ABSTRACT

A footwear heel stabilizing construction comprising an upper portion, a midsole fitted to said upper and having a heel cushion portion in said midsole, said heel cushion embraced in a frame in which the frame has a series of cushion retaining finger elements surrounding said cushion to retain said cushion in a configuration presented to the bottom of said footwear upper portion, and an outsole secured to said midsole to provide a walking surface for the footwear.

2 Claims, 3 Drawing Sheets

FOOTWEAR HEEL STABILIZER CONSTRUCTION

CROSS-REFERENCE TO RELATED APPLICATIONS

STATEMENT REGARDING FEDERALLY SPONSORED RESEARCH OR DEVELOPMENT

Not Applicable

BACKGROUND OF THE INVENTION

The invention is directed to footwear having a heel stabilizing construction in which a heel cushion is supported in a frame which helps to maintain the shape of the heel during use.

The prior art relating to footwear heel construction is exemplified by Dyer U.S. Pat. No. 5,325,611 of Jul. 5, 1994, and prior to that other patented construction relating to footwear heels are seen in Diaz U.S. Pat. No. 4,815,221 of Mar. 28, 1989; Kiyosawa U.S. Pat. No. 4,878,301 of Nov. 7, 1989; Graham et al. U.S. Pat. No. 4,879,821 of Nov. 14, 1989, and Graham et al. U.S. Pat. No. 5,070,629 of Dec. 10, 1991.

A problem with the prior art examples in that the heel of a shoe needs to be graded for size which introduces construction problems to meet the needs of users such as is present in the Diaz heel which embodies energy control means that is responsive to foot heel size changes, or is too rigid to be comfortable.

BRIEF SUMMARY OF THE INVENTION

An object of the invention is to select a shoe heel cushion of a suitable soft material and to combine that cushion with a frame which stabilizes the cushion position in the shoe.

Another object of the invention is to embody in a cushion recesses embracing fingers for retaining the cushion in a desired configuration.

A further object of the invention is to provide a molded frame having preshaped finger elements positioned to receive a heel cushion in a wrapped engagement along opposite sides of the cushion such that the frame resists supination and pronation of the foot which usually results in misshaping and breakdown of the heel cushion.

The foregoing and other objects of the invention will appear in the following specification.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of examples and not by way of limitation. This description will clearly enable one skilled in the art to make and use the invention and describes what is presently believed to be the best mode of carrying out the invention.

Figure 1:
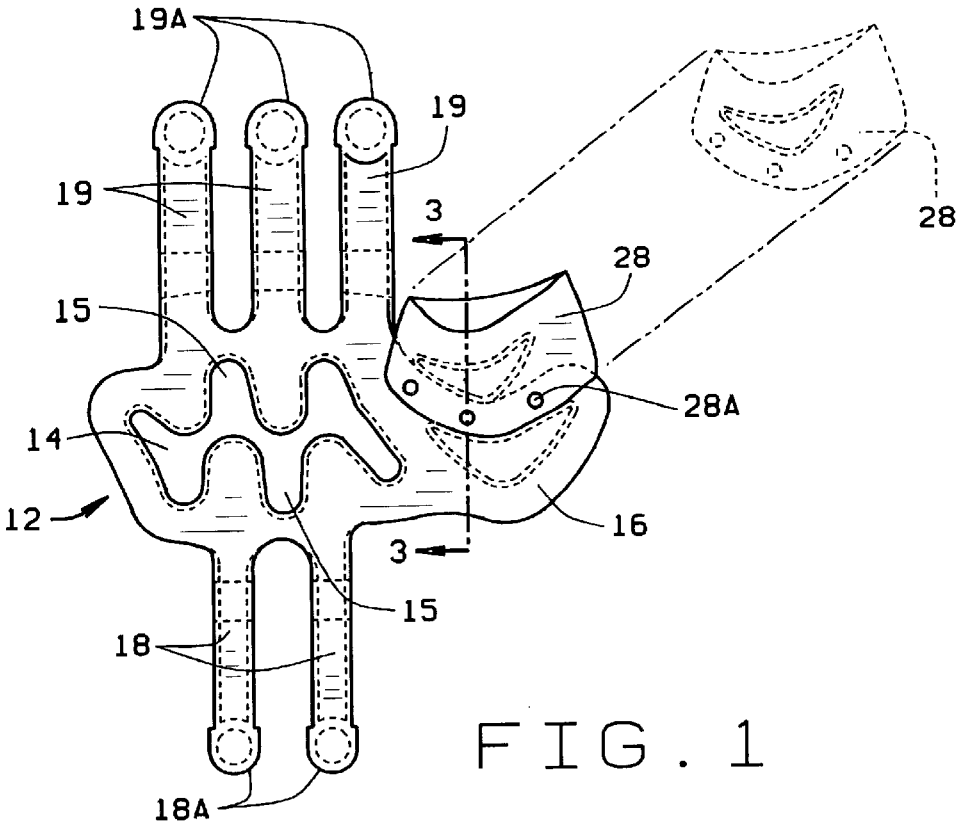
FIG. 1 is a plan view of a molded frame formation for retaining the shape of a heel cushion.
Figure 9:
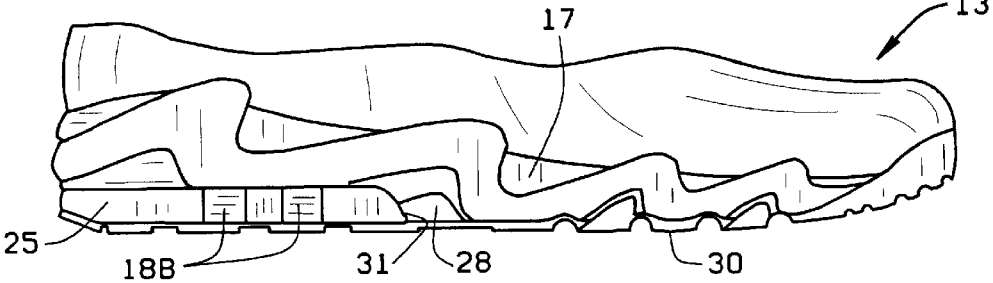
FIG. 9 is a longitudinal side elevational view of the outsole and midsole with the framed heel cushion in assembled position relative to a fragmentary portion of an upper.

FIG. 1 is a plan view shown at 12 of a frame element which is to be embodied under the midsole of a footwear seen in FIG. 9 having a main body 13. The frame 12 is formed with a particular elongated central open design configuration 14 having loop shaped recesses 15 forming a plurality of fingers which project into the central opening from opposite margins, and with a tab 16 which is directed into the insole instep area of the midsole 17 of the shoe 13. The main body of the frame 12 is formed with a pair of fingers 18 which extends from one side and the opposite side is formed with three such fingers 19 in the manner shown. It is noted that the fingers 18 are rather slender in relation to the fingers 19 for a purpose that will soon be made evident. In addition, the ends of the respective fingers are enlarged at 18A and 19A to obtain retention in the final placement to be explained presently.

Figure 2:
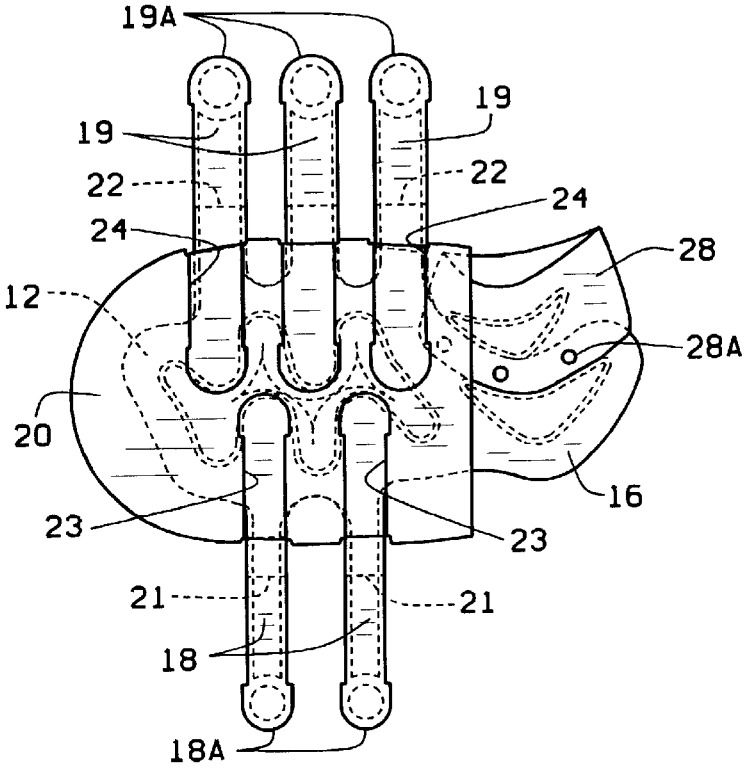
FIG. 2 is a plan view of a mandrel and frame showing the formation of a heel configuration.
Figure 3:
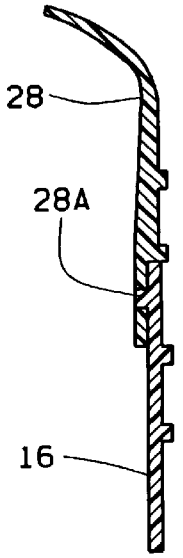
FIG. 3 is a fragmentary sectional detail at line 3—3 in FIG. 1 of the attachment of a component to the frame for a heel cushion.
Figure 4:
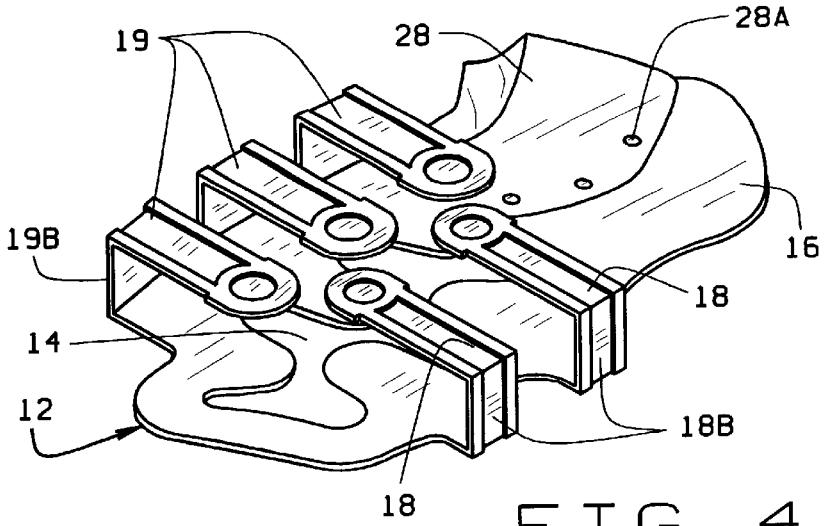
FIG. 4 is a perspective view of the completed frame for a heel cushion.

FIG. 2 is an illustration of the member 12 shown in FIG. 1 having the tab 16 extending into the instep area and there is a mandrel body 20 placed over the body 12 of the framing member for a purpose to illustrate how the fingers 18 and 19, respectively, are brought into a bent form as clearly shown in FIG. 4. The view of FIG. 2 shows where on finger 18 there are dotted lines 21 to indicate the area where the fingers 18 are folded so as to bring them over the mandrel 20 shown in FIG. 2. In a like manner, the fingers 19 are drawn with dotted fold lines 22 for the same purpose of indicating where the fingers 19 are to be bent so as to bring them into a position relative to the mandrel 20. It is important to note that the mandrel 20 is formed with recesses 23 which are to be occupied by the fingers 18 when they are folded. In a like manner, the opposite side of the mandrel 20 is formed with recesses 24 which are adapted to receive the respective fingers 19 when they are folded.

Turning now to FIG. 4 there is shown the frame member 12 in a final shaped configuration in which the pair of fingers 18 are brought into bent position and the respective fingers 19 are also brought into respective position so that these fingers overlie the open configuration 14 formed in the body of the frame 12. The frame 12 has the tab 16 projecting outwardly so as to extend into the instep area of the final shoe configuration.

Figure 5:
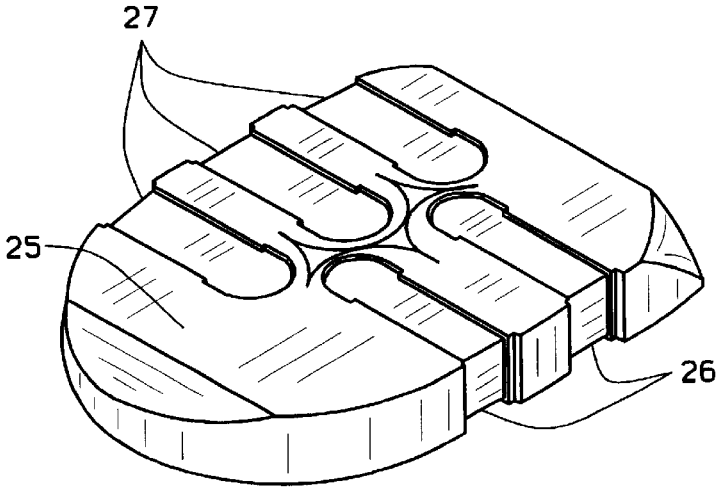
FIG. 5 is a preformed heel cushion prior to being assembled in a frame.
Figure 6:
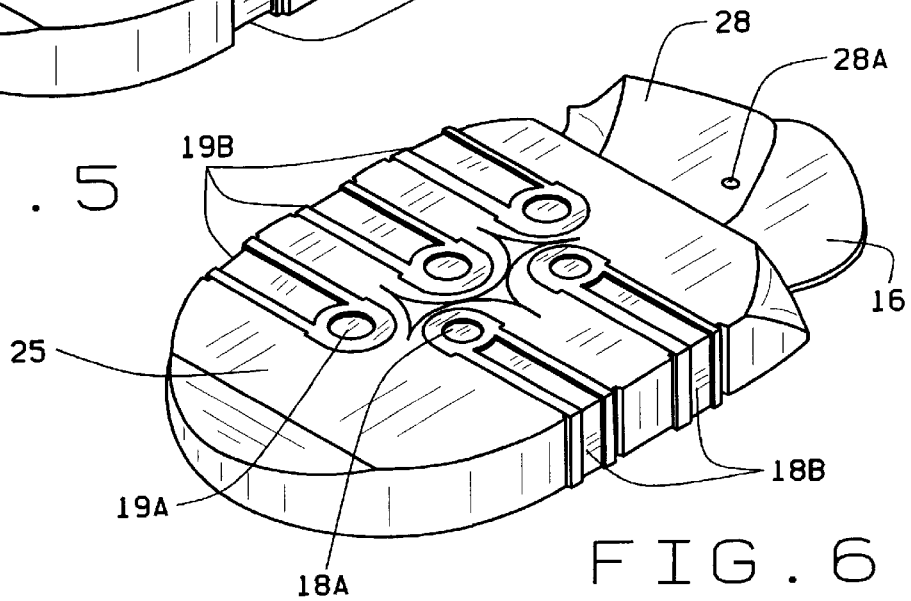
FIG. 6 is the assembled frame and heel cushion as seen from the midsole side.

Turning now to FIG. 5, there is illustrated a cushion 25 which is adapted to be slipped into the frame of FIG. 4 to replace the mandrel 20 shown in FIG. 2. In FIG. 5, the cushion is indented at 26 with recesses to receive the respective fingers 18 which are then brought into those recesses and are adhesively anchored. In a like manner, the opposite side of the cushion 25 is formed with recesses or indentations 27 which are adapted to receive fingers 19 respectively and the fingers 18 and 19 are therefore brought into a wrapped condition around the cushion 25 as is clearly illustrated in FIG. 6 with the enlarged ends 18A and 19A secured as noted. When the assembly shown in FIG. 6 is prepared to be installed in a shoe 13, it is noted that the side edges 18B seen in FIG. 4 and indicated by side edges 19B on the opposite side are indicated to have the fingers 18A and 19A lying in the recesses to form a design configuration allowing the side of the cushion 25 to assume a similar design configuration seen in FIG. 6. If the cushion can be turned from the assembly of FIG. 4 so that the opposite side 19A is made visible, a similar design configuration will be seen.

Returning to FIGS. 1, 4 and 6, the molded frame 12 provides a tab 16 which projects out from the frame 12 and is used to support a projecting instep element 28. That shaped element 28 is formed with small projection 28A which are press fitted into matching apertures in the tab 16. The material for the frame 12 may be thermal polyurethane, or ethylvinyl acetate, or nylon or any suitable material which is readily moldable and has a tendency to hold its desired shape When positioned to embrace the mandrel 20 so that upon removal of the mandrel, the finger elements 18 and 19 will retain the desired shape seen in FIG. 4. Thereafter, a cushion 25 shaped as seen in FIG. 5 will receive the frame 12 of FIG. 4 and easily accommodate the adhesive union of frame 12 and cushion 25.

Figure 7:
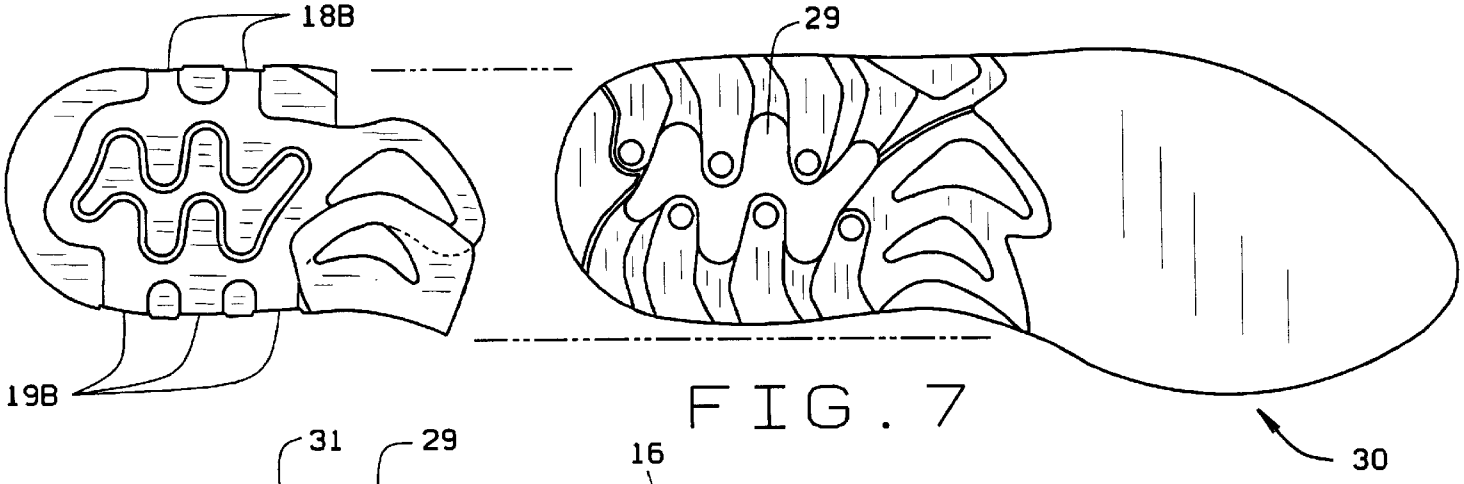
FIG. 7 is a composite plan view of the bottom of the heel frame applied to a cushion prior to combining that component with an outsole.
Figure 8:
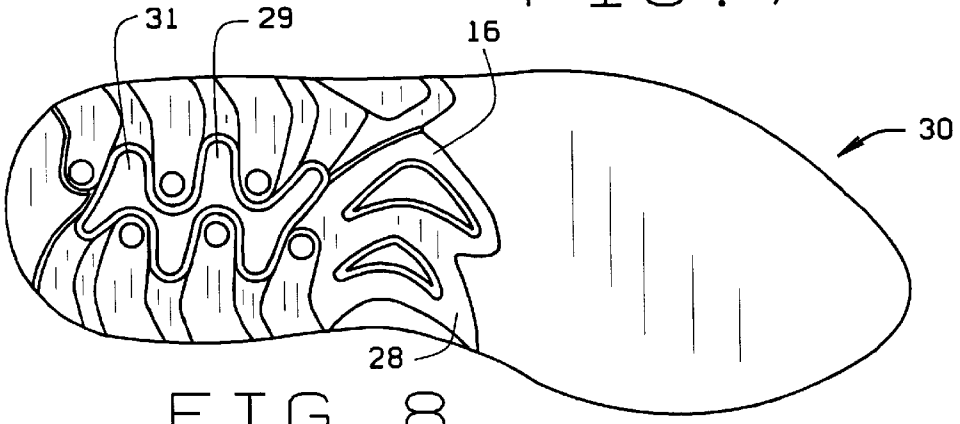
FIG. 8 is the assembly of the parts of heel and outsole.

When the assembled frame 12 and cushion 25 of FIG. 6 is turned over as illustrated in FIG. 7, the bent portions 18B and 19B will have an appearance along the vertical edges of the heel cushion (See FIG. 6). The final assembly is to adhesively join the outsole 30 to enclose the heel cushion 25 so it is embedded between the outsole 30 and the midsole 17 (FIG. 9). In this assembly, the tab 16 with its attachment 28 will be exposed in the cushion area 31 through the opening 29 (See FIGS. 7 and 8) in outsole 30 in the heel and shank area.

Whichever material is selected for the heel of a shoe, it is important that the heel construction system having the resilient finger elements wrapped around the cushion in the manner seen in FIG. 6. The resulting construction of the cushion 25 in both the medial and lateral margins will have those fingers impart support to the margins so the cushion 25 will overcome foot tendencies to turn or roll inwardly in a pronation reaction or outwardly in a suppination reaction. Such a pronation or suppination reaction results ultimately in the misshaping of the shoe heel, and that misshaping accentuates the stress in the heel. In the view of FIG. 6, the medial side of the heel cushion 25 is supported by three of the finger elements 19, while the lateral side is supported by two finger elements 18. These finger elements collectively support the body of the cushion against allowing the heel to turn or rotate and loose its comfort position of support. The finger elements have enlarged ends 18A and 19A which when recessed into the cushion exert the holding of the cushion in a shape that resists deformation.

Having described the heel cushion and its shape stabilizing construction, it can be appreciated that the heel cushion and its frame 12 can be assembled in a shoe midsole 17 between the outsole 30 and the upper 13 as seen in FIG. 9. Thus, the stabilizing construction is integrated within the shoe such that the bent portions 18B and the bend portions on 19B on the opposite vertical side edge are established to retain the cushion in a desired configuration in the midsole.

In view of the above it can be appreciated that several objects and advantages of the invention have been achieved and other advantageous results have been obtained. Various changes could be made in the foregoing construction without departing from the scope of the invention, and it is intended that all matter contained in the above description or shown in the accompanying drawings shall be interpreted as illustrated and not in a limiting sense.

What is claimed is:

1. In footwear heel stabilizing construction to maintain the heel shape, the heel construction comprising:

a) a cushion having upper and lower surfaces and lateral and medial sides, said cushion having indentations in said lateral and medial sides and in said upper surface, and said cushion being substantially in all areas between said sides;

b) a heel cushion shape stabilizing frame positioned against said cushion lower surface and having preshaped fingers fitted in said indentations in each of said sides and said finger extending into said cushion indentations in said upper surface; and c) adhesive material retaining said preshaped fingers wrapped into said indentations in said lateral and medial sides and into said upper surface of said cushion, wherein said fingers maintain the shape of said cushion.

2. The heel construction set forth in claim 1 wherein said indentations shaped in said cushion upper surface have enlarged ends and said preshaped fingers projecting over said cushion upper surface have enlarged ends seated in said enlarged ends of said indentations, whereby said enlarged finger ends and said enlarged indentations in said upper surface exert a shape holding force on said cushion.

* * * * *

UNITED STATES PATENT AND TRADEMARK OFFICE

CERTIFICATE OF CORRECTION

PATENT NO : 5,937,545

DATED : August 17, 1999

INVENTOR(S) : Robert M. Dyer, Zenon O. Smotrycz and Edward J. Norton

It is certified that error appears in the above-identified patent and that said Letters Patent is hereby corrected as shown below:

Col. 4, line 29
replace "substantially in"
with --substantially continuous in--.

Signed and Sealed this

Twenty-eighth Day of March, 2000

*Attest:*

Q. TODD DICKINSON

*Attesting Officer*

*Commissioner of Patents and Trademarks*